US006239758B1

(12) United States Patent
Fuchs et al.

(10) Patent No.: US 6,239,758 B1
(45) Date of Patent: May 29, 2001

(54) VEHICLE WINDOW ANTENNA SYSTEM

(75) Inventors: Andreas Dirk Fuchs, Orion Township; Ralf Albert Duersch, Auburn Hills; Ralf Lindackers, Waterford, all of MI (US)

(73) Assignee: RecepTec L.L.C., Holly, MI (US)

( * ) Notice: Subject to any disclaimer, the term of this patent is extended or adjusted under 35 U.S.C. 154(b) by 0 days.

(21) Appl. No.: 09/490,794

(22) Filed: Jan. 24, 2000

(51) Int. Cl.[7] ..... H01Q 1/32
(52) U.S. Cl. ..... 343/713; 343/704
(58) Field of Search ..... 343/704, 713; H01Q 1/02, 1/32

(56) References Cited

U.S. PATENT DOCUMENTS

| | | | |
|---|---|---|---|
| 4,439,771 | 3/1984 | Kume et al. | 343/713 |
| 4,602,260 | 7/1986 | Lindenmeier et al. | 343/713 |
| 4,791,426 | 12/1988 | Lindenmeier et al. | 343/713 |
| 4,823,140 | 4/1989 | Shibata et al. | 343/713 |
| 4,914,447 | 4/1990 | Ishii et al. | 343/713 |
| 4,992,801 | 2/1991 | Saito et al. | 343/713 |
| 5,005,020 | 4/1991 | Ogawa et al. | 343/713 |
| 5,029,308 | 7/1991 | Lindenmeier et al. | 343/704 |
| 5,049,892 | 9/1991 | Lindenmeier et al. | 343/713 |
| 5,083,134 | 1/1992 | Saitou et al. | 343/713 |
| 5,097,270 | 3/1992 | Lindenmeier et al. | 343/713 |
| 5,132,161 | 7/1992 | Shibata et al. | 343/713 |
| 5,138,330 | 8/1992 | Lindenmeier et al. | 343/713 |
| 5,204,979 | 4/1993 | Schenkyr et al. | 343/713 |
| 5,264,585 | 11/1993 | Shiina | 343/713 |
| 5,289,197 | 2/1994 | Lindenmeier et al. | 343/713 |
| 5,365,242 | 11/1994 | Shiina | 343/713 |
| 5,581,264 | 12/1996 | Tabata et al. | 343/713 |
| 5,654,720 | 8/1997 | Saitou et al. | 343/713 |
| 5,654,721 | 8/1997 | Saitou et al. | 343/713 |
| 5,719,585 | 2/1998 | Tabata et al. | 343/713 |
| 5,781,160 * | 7/1998 | Walton | 343/713 |
| 5,821,904 * | 10/1998 | Kakizawa et al. | 343/713 |
| 5,877,727 | 3/1999 | Saitou et al. | 343/713 |
| 5,945,957 * | 8/1999 | Kakizawa | 343/713 |

* cited by examiner

*Primary Examiner*—Don Wong
*Assistant Examiner*—Hoang Nguyen
(74) *Attorney, Agent, or Firm*—Warner Norcross & Judd LLP

(57) ABSTRACT

A vehicle window/antenna system with enhanced heating and AM/FM reception. The system includes a window and a heating/antenna grid supported thereon. The grid is separated into upper and lower portions, and functions as an FM antenna. A flat AM antenna is supported on the window between the upper and lower grid portions. The positioning of the AM antenna within the heating grid enables ice and snow to be cleared from the AM antenna. Antenna leads extend from both the upper and lower grid portions as well as the AM antenna. The two FM leads are connected to a Balun transformer to balance the FM signals.

20 Claims, 2 Drawing Sheets

VEHICLE WINDOW ANTENNA SYSTEM

BACKGROUND OF THE INVENTION

The present invention relates to active antenna systems incorporated into vehicle windows, and more particularly to such systems including two or more antennas for different frequency ranges (such as AM and FM).

Active antenna systems are widely used in automotive applications. Such systems include mast antennas and window antennas, which may be integrated into the front, side, or rear windows of a vehicle. Increasingly, the rear window has become a candidate for antenna placement in view of recent aerodynamic design trends. Specifically, the window surface area has increased, particularly on the rear window where the glass is often mounted at a very low angle. Heating the entire rear window for visibility is not necessary, and accordingly, heating grids are typically located over only a portion, for example half, of the glass area. The non-heating grid portion of the window provides adequate space for antennas.

It is known to use the heating grid on one of the vehicle windows (usually the rear window) as an antenna for either AM or FM. In such cases, it is necessary to include a second antenna for the other of AM or FM. Fortunately, with the increased surface area on rear windows, there is adequate room for both a heating grid and a second antenna.

In a first approach, the heating grid is used as the FM antenna; and a flat AM antenna is incorporated on or in the glass above the heating grid. The system is optimized by both the configuration of the AM antenna and its spacing from the heating grid and the surrounding sheet metal. An example of such a system is illustrated in U.S. Pat. No. 4,791,426 issued Dec. 13, 1988 to Lindenmeier et al and entitled "Active Antenna in the Rear Window of a Motor Vehicle."

In a second approach, the heating grid is used as the AM antenna, which is isolated to ground through an inductor or coil. A separate FM antenna is incorporated on or in the glass above the heating grid, and the FM antenna is capacitively coupled to the heating grid.

A disadvantage of both approaches is the reduced sensitivity of the unheated antenna during snow and ice build-up. The heating grid melts snow and ice only in the area of the grid, and consequently snow and ice can accumulate on top of the unheated antenna. Such build-up reduces the sensitivity and performance of the unheated antenna by as much as 3 to 7 dB (decibels).

Further, use of the Lindenmeier design on increasingly larger rear windows results in an AM antenna with extremely high gain and sensitivity. This can be undesirable because additional countermeasures must be taken to reduce vehicle noise, overload, FM intrusion, power line noise, and radio settings (e.g. stereo/mono threshold, noise blanker, and frequency high cut). Such counter measures are costly and may also raise the noise floor of the system.

SUMMARY OF THE INVENTION

The aforementioned problems are overcome in the present invention wherein both AM and FM antennas are provided and configured on a vehicle window so that snow and ice can be removed from both antennas. Specifically, the window heating grid serves as the FM antenna. The heating grid is separated into upper and lower portions spaced from one another. A flat AM antenna is positioned between the upper and lower portions of the heating grid so as to be substantially surrounded by the heating grid.

The new design has several advantages. First, snow and ice can be removed from the entire antenna area because the heating grid surrounds the AM antenna. Consequently, activation of the heating grid produces enough heat in the AM antenna area to melt at least the undersurface of snow and ice so that they slide off the entire antenna area, if not melt completely. Second, because the AM antenna is surrounded by the heating grid, the sensitivity of the AM antenna is reduced to a desired level, eliminating the need for countermeasures.

These and other objects, advantages, and features of the invention will be more readily understood and appreciated by reference to the detailed description of the preferred embodiments and the drawings.

DETAILED DESCRIPTION OF THE PREFERRED EMBODIMENTS

I. First Embodiment

Figure 1:
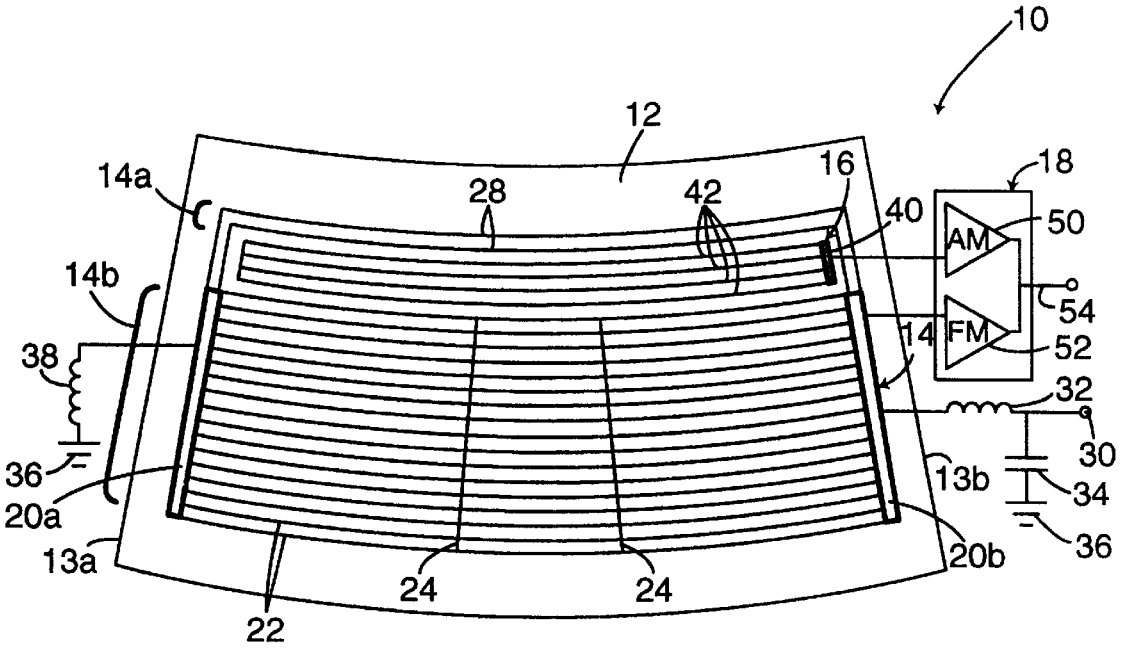
FIG. 1 is a schematic diagram of a first embodiment of the invention.

A vehicle window and antenna system constructed in accordance with a first embodiment of the invention is illustrated in FIG. 1 and generally designated 10. The system includes a window 12, a heating/FM antenna grid 14, an AM antenna 16, and an active amplifier system 18. The grid 14 is arranged, or separated, into an upper portion 14*a* and a lower portion 14*b*. The AM antenna 16 is positioned between the upper and lower grid portions 14*a* and b so as to be substantially surrounded by the grid 14. The amplifier system 18 provides an active output to the radio.

The present invention results in enhanced snow and ice removal, particularly from the AM antenna 16. The heat from the upper and lower portions 14*a* and b of the heating grid 14 cooperates to remove snow and ice from the AM antenna 16. At a minimum, the heating grid 14 surrounding the AM antenna 16 "cuts" a block of snow or ice that may be over the AM antenna so that the block can slide down onto the lower portion 14*b* for melting. Consequently, the sensitivity of the AM antenna is not impacted by accumulations of snow and ice as in prior art antennas.

The window, glass, or window substrate 12 is generally well known to those skilled in the art and will not be described in detail. Appropriate glass is manufactured, for example, by PPG Industries of Pittsburgh, Pennsylvania and Libby-Owens-Ford of Toledo, Ohio. The present invention is not dependent on the window or glass. The window 12 includes a pair of lateral or side edges 13*a* and 13*b* defining the width of the window.

Also, the techniques (but not the configuration) for forming the heating grid 14 and the antenna 16 are generally well known. For example, the grid and antenna can be silk-screened onto the interior of the glass or sandwiched between layers of the glass. The particular technique for creating the antennas 14 and 16 is not important to the present invention.

The heating antenna grid 14 is used both to heat the window 12 and to serve as the FM (frequency modulation)

antenna. As noted above, the FM antenna 14 is arranged or divided into two portions—an upper portion 14*a* and a lower portion 14*b*.

The lower portion 14*b* includes a pair of opposite bus bars 20*a* and 20*b* located proximate the side edges of the window 12. A plurality of horizontal grid lines 22 extend between the bus bars 20 to provide an electrically conductive path therebetween. The number of lines will depend on the desired heating and antenna characteristics. Vertical improvement lines 24 interconnect the horizontal lines 22 to improve FM reception as generally know in the art. Additionally, one or more lines (not shown) of varying configuration can be added at the bottom of the grid to fine-tune antenna characteristics, again as generally known in the art.

The upper portion 14*a* of the heating grid/FM antenna 14 includes lines 28 which are electrically connected to the bus bars 20. The lines 28 of the upper portion 14*a* are spaced from the horizontal lines 22 of the lower portion 14*b*. As illustrated, the upper portion 14*a* includes two lines 28. Greater or fewer lines 28 can be included depending on the window configuration and antenna application. It is believed that a single line will perform adequately.

Circuitry is included for supplying electrical power to the heating grid 14. Specifically, power is supplied to the bus bar 20*b* through a coil 32. The high voltage is grounded 36 through an RF filter 34, which serves as an FM isolation coil. The bus bar 20*a* is grounded 36 through coil 38. The described system of powering the heating grid is generally known to those skilled in the art. Other power supply circuitry could be used depending on the application.

The second or AM antenna 16 is a flat antenna located between the upper portion 14*a* and the lower portion 14*b* of the FM antenna. The AM antenna 16 includes a side bar 40 and a plurality of linear elements or horizontal lines 42. Other configurations for implementing a flat antenna are generally known to those skilled in the art. For example, the antenna could include one or more discrete areas of conductive film of the type used in metallized heat-reflecting windows. The flat antenna is completely surrounded by the grid 14.

The amplifier system 18 is also generally known in the art. The system includes an AM amplifier 50 coupled to the AM antenna 16 and an FM amplifier 52 coupled to the FM antenna 14. The output of the amplifiers 50 and 52 both feed to a common coaxial connection 54 which may be connected to a radio.

Second Embodiment

Figure 2:
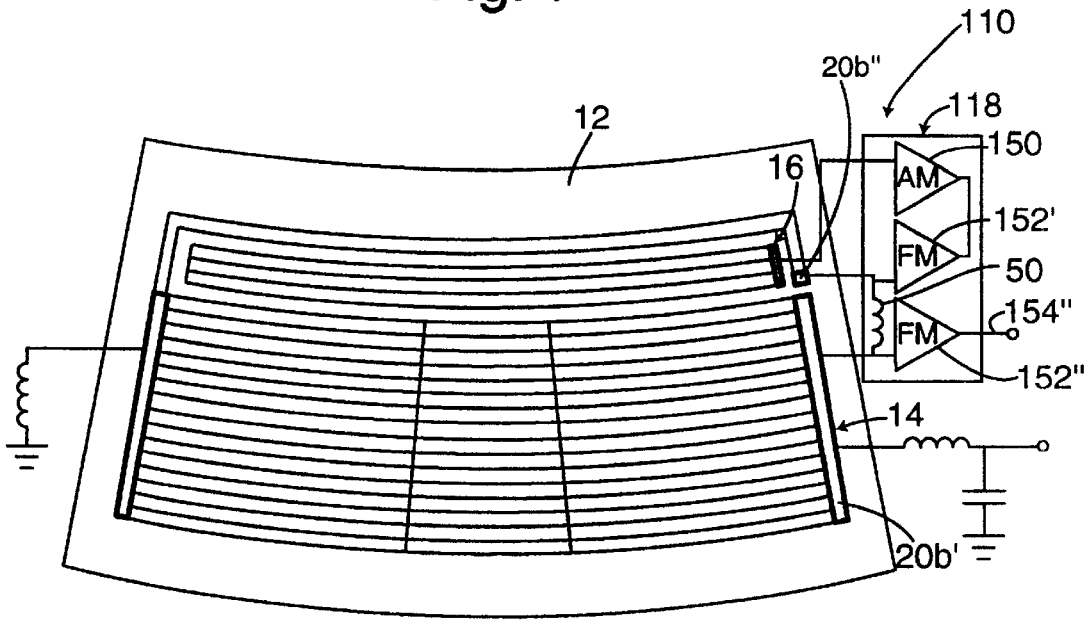
FIG. 2 is a schematic diagram of a second embodiment of the invention.

A second embodiment of the invention is illustrated in FIG. 2 and generally designated 110. The window 12 and grids 14 and 16 of the second embodiment are identical to their counterparts in the first embodiment 10 with one exception. Specifically, the bus bar 20*b* has two portions—a lower portion 20*b*' and an upper portion 20*b*" separated from one another on the window by a relatively short distance. Consequently, the antenna 16 is substantially surrounded by the grid 14. However, the two portions 20*b*' and 20*b*" are electrically interconnected through a coil 50 in the amplifier system 118.

The amplifier system 118 is different from the amplifier system 18 of the previous embodiment. Specifically, the amplifier system 118 provides diversity of antenna in the FM frequency range. The amplifier system 118 includes an AM amplifier 150 and a pair of FM amplifiers 152' and 152". The AM amplifier receives its input from the AM antenna 16. The first FM amplifier 152' receives its input from the upper bus portion 20*b*; and the second FM amplifier 152" receives its input from the lower bus portion 20*b*'. The output of the AM amplifier 150 and the first FM amplifier 152' are connected to an AM/FMI lead 154'. And the output of the second FM amplifier 152"is connected to the FM2 lead 154".

The remaining components of the second embodiment 110 are the same as the first embodiment 10.

Third Embodiment

Figure 3:
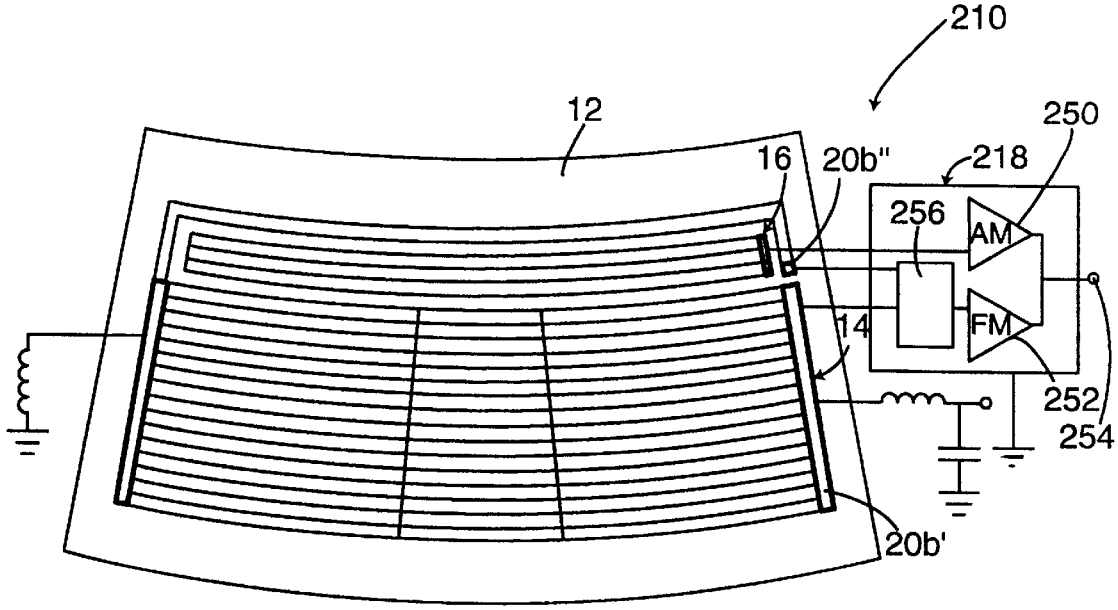
FIG. 3 is a schematic diagram of a third embodiment of the invention.

A third embodiment of the present invention is illustrated in FIG. 3 and is generally designated 210. The window 12, the antenna heating grid 14, and the AM antenna 16 are all identical to those of the second embodiment 110. Only the amplifier system 218 is different from the second embodiment.

The amplifier system 218 includes an AM amplifier 250 that receives its input from the AM antenna 16. The system 218 further includes an FM amplifier 252 and a Balun transformer 256. The transformer 256 is connected to both of the bus bar portions 20*b*' and 20*b*", and has a single output connected to the input of the FM amplifier 252. As is known in the art, the Balun transformer forces balancing between the two antenna inputs. Accordingly, the directionality of the FM antenna is improved; and currents within the antenna lead 254 are eliminated.

Spacing and Relationships

Figure 4:
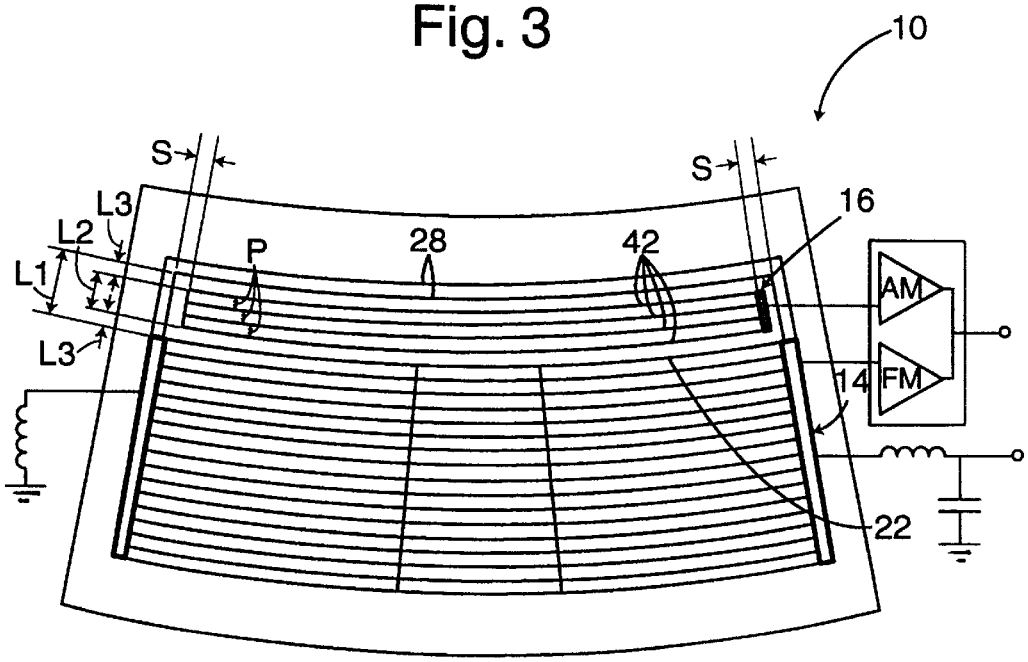
FIG. 4 is a view similar to FIG. 3 and additionally showing desired spacing relationships between the antenna elements.

FIG. 4 is the same as FIG. 1 and additionally includes identifiers related to the spacing and relationships of the AM antenna elements—both to one another and to the grid 14. The spacings indicated on FIG. 4 are as follows:

$L_1$ The vertical distance between the upper grid portion 14*a* and the lower grid portion 14*b* (preferably in the range of 140 mm to 160 mm)

$L_2$ The height of the AM antenna $L_3$ The vertical distance between the AM antenna and both of the upper grid portion 14*a* and the lower grid portion 14*b* s The horizontal distance between the AM antenna and the grid 14 (preferably a minimum of 2 mm)

s The spacing between the AM antenna elements n The number of antenna elements (preferably 3 or 4 lines)

The currently preferred approximate relationships between the spacings are as follows:

$$L_2 = \frac{2L_1}{3}$$

$$L_3 = \frac{L_1 - L_2}{2}$$

$$p = \frac{L_2}{n-1}$$

The defined spacings and relationships are believed to optimize AM gain and to provide a signal-to-noise ratio closely approximating that of a conventional passive mast antenna mounted externally on a rear fender of a vehicle. The dimensions $L_1$, $L_2$, and $L_3$ will vary with the sensitivity of the amplifier connected to the grid.

All of the embodiments have been described in conjunction with AM and FM frequencies. The present invention is readily extendable to other frequencies (e.g. long wave (LW) and short wave (SW) frequencies) by appropriate modification of the antennas. Also, more than two frequency ranges are possible through the inclusion of additional antennas on the window.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A vehicle window with heating and antenna capabilities comprising:

a window substrate having a pair of opposite side edges;

a heating/antenna grid supported by said window, said grid including a pair of bus bars each proximate one of said side edges, said grid further including a plurality of heating elements extending between said bus bars, said elements arranged into an upper group of one or more elements and a lower group of one or more elements;

a second antenna supported by said window, said second antenna located between said upper group of elements and said lower group of elements; and connector means for receiving electromagnetic signals from both said heating/antenna grid and said second antenna.

2. A vehicle window as defined in claim 1 wherein said connector means includes:

first and second leads connected to said upper and lower groups, respectively; and balancing means connected to said first and second leads for balancing the signals therefrom.

3. A vehicle window as defined in claim 2 wherein said balancing means is a Balun transformer.

4. A vehicle window as defined in claim 1 wherein:

said heating antenna grid is adapted to receive signals in the FM range; and said second antenna is adapted to receive signals in the AM range.

5. A vehicle window as defined in claim 1 wherein said second antenna is a flat antenna including a plurality of elements.

6. A vehicle window as defined in claim 1 wherein said heating/antenna grid elements comprise lines.

7. A window/antenna system comprising:

a window;

an electrically conductive heating/antenna grid supported by said window, said heating/antenna grid having an upper portion and a lower portion;

a second antenna supported by said window, said second antenna located between said upper and lower portions.

8. A window/antenna system as defined in claim 7 further comprising:

first and second leads connected to said upper and lower portions, respectively; and balancing means for balancing the signals received from said upper and lower portions through said first and second leads.

9. A window/antenna system as defined in claim 8 wherein said balancing means comprises a Balun transformer.

10. A window/antenna system as defined in claim 7 wherein said second antenna comprises a flat antenna.

11. A window/antenna system as defined in claim 10 wherein said flat antenna comprises a plurality of linear elements.

12. A window/antenna system as defined in claim 7 wherein:

said heating/antenna grid is adapted to receive signals in the FM range; and said second antenna is adapted to receive signals in the AM range.

13. A window/antenna system as defined in claim 7 wherein:

said window includes a pair of opposite side edges defining a width; and said heating/antenna grid includes a pair of bus bars each proximate one of said side edges.

14. A window/antenna system as defined in claim 13 wherein said heating/antenna grid further includes a plurality of linear elements extending between said pair of bus bars, each of said upper and lower portions including at least one of said linear elements.

15. A heated vehicle window with antenna capabilities comprising:

a window having a pair of opposite side edges defining a width;

a first heating/antenna grid supported by said window, said grid including a pair of bus bars each proximate one of said side edges and a plurality of grid lines extending therebetween, said grid lines being arranged into an upper group of one or more lines and a lower group of one or more lines, said upper and lower groups spaced from one another, said heating/antenna grid adapted to receive signals in the FM range;

a flat antenna supported by said window and located between said upper group and said lower group of said heating/antenna grid, said flat antenna extending substantially the width of said window, said flat antenna adapted to receive signals in the AM range;

a plurality of leads each connected to one of said upper group, said lower group, and said flat antenna; and balancing means connected to said leads for balancing the FM signals received from said upper and lower groups.

16. A vehicle window as defined in claim 15 wherein said balancing means comprises a Balun transformer.

17. A vehicle window as defined in claim 15 wherein said flat antenna includes a plurality of linear elements.

18. A vehicle window as defined in claim 15 where said flat antenna includes one or more discrete areas of conductive film.

19. A vehicle window with antenna capabilities comprising:

a window glass;

a heating/antenna grid supported by said window glass, said grid arranged into upper and lower grid portions separated from one another;

a second antenna supported by said window, said second antenna located between said upper and lower grid portions; and a Balun transformer connected to said first and second grid portions thereby balancing said first and second grid portions.

20. A vehicle window as defined in claim 21 wherein:

said grid is adapted to receive signals in the FM range; and said second antenna is adapted to receive signals in the AM range.

* * * * *

UNITED STATES PATENT AND TRADEMARK OFFICE

CERTIFICATE OF CORRECTION

PATENT NO. : 6,239,758 B1
DATED : May 29, 2001
INVENTOR(S) : Fuchs et al.

It is certified that error appears in the above-identified patent and that said Letters Patent is hereby corrected as shown below:

Column 6, claim 20,
Line 61, "21" should be -- 19 --

Signed and Sealed this

Fifth Day of February, 2002

*Attest:*

*Attesting Officer*

JAMES E. ROGAN
*Director of the United States Patent and Trademark Office*